US005291218A

United States Patent [19]

DeBoer

[11] Patent Number: 5,291,218

[45] Date of Patent: Mar. 1, 1994

[54] SPACER RAILS FOR LASER DYE TRANSFER TRANSPARENCIES

[75] Inventor: Charles D. DeBoer, Rochester, N.Y.

[73] Assignee: Eastman Kodak Company, Rochester, N.Y.

[21] Appl. No.: 956,712

[22] Filed: Oct. 5, 1992

Related U.S. Application Data

[63] Continuation-in-part of Ser. No. 799,471, Nov. 26, 1991.

[51] Int. Cl.[5] ..... B41M 5/26

[52] U.S. Cl. ..... 346/76 PH; 503/227

[58] Field of Search ..... 503/227; 430/200, 945; 428/195, 206, 323, 327, 480, 913, 916; 346/76 PH

[56] References Cited

U.S. PATENT DOCUMENTS

| | | | |
|---|---|---|---|
| 3,706,276 | 12/1972 | Yamada et al. | 101/453 |
| 4,772,582 | 9/1988 | DeBoer | 503/227 |
| 4,876,235 | 10/1989 | DeBoer | 503/227 |

FOREIGN PATENT DOCUMENTS

| | | |
|---|---|---|
| 0321922 | 6/1989 | European Pat. Off. . |
| 0411924 | 2/1991 | European Pat. Off. . |

*Primary Examiner*—Benjamin R. Fuller

*Assistant Examiner*—Huan Tran

*Attorney, Agent, or Firm*—Harold E. Cole

[57] ABSTRACT

This invention relates to a thermal dye transfer assemblage comprising:

a) a dye-donor element comprising a support having thereon a dye layer and an infrared absorbing material associated therewith, and b) a dye-receiving element comprising a support having thereon a dye image-receiving layer having a given image area, the dye-receiving element being in a superposed relationship with the dye-donor element so that the dye layer is adjacent to the dye image-receiving layer, the improvement wherein spacer rails having a height of about 3 to about 50 μm are located between the dye-donor element and the dye-receiving element, the spacer rails being located just outside the image area of the assemblage in such a location so as to separate the dye-donor from the dye-receiver across the entire image area; and the dye-donor element support and the dye-receiving element support either being rigid and flat or being held rigid and flat in the assemblage so that there is no more than an insignificant sag at the area midway between said rails.

16 Claims, No Drawings

SPACER RAILS FOR LASER DYE TRANSFER TRANSPARENCIES

CROSS REFERENCE TO RELATED APPLICATION

This application is a continuation-in-part of copending U.S. application Ser. No. 07/799,471 filed Nov. 26, 1991 now abandoned.

This invention relates to the use of spacer rails between a donor and receiver in a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Spacer beads may be employed in a separate layer over the dye layer of the dye-donor in the above-described laser process in order to prevent sticking of the dye-donor to the dye-receiver during dye transfer, and also to increase the uniformity and density of the transferred image. That invention is more fully described in U.S. Pat. No. 4,772,582.

There is a problem with using spacer beads in the donor element in that the beads hinder or prevent dye passage to the receiver. The beads also cause shadows to appear in the transferred image.

Alternatively, spacer beads may be employed in the dye image-receiving layer of the dye-receiver as described in U.S. Pat. No. 4,876,235. This patent indicates that a controlled space between the donor and receiver is required to obtain a good uniform image in laser dye transfer. If there is no space, two problems can occur during printing. First, the printing density may be very low, probably because direct contact with the receiver draws much of the heat away from the donor creating a cool surface. Second, the donor and receiver tend to stick together under the melting heat of the laser. When separation is attempted, the donor layer is stripped from its support, destroying image discrimination by producing areas of very high density. These random alternating patches of very low and very high density make a highly mottled and unusable image. The solution to the problem described in U.S. Pat. No. 4,876,235 was to separate the donor and receiver elements by means of matte beads coated in the dye image-receiving layer. Because the matte beads are very small, 3 to 50 μm, they usually appear practically invisible to the eye in normal, unmagnified viewing.

One problem with matte beads as spacers within the imaging area of the receiver is that they create tiny defects in the image that are visible when magnified, such as a 35 mm slide image which is magnified 25 times or more when projected onto a large screen.

It would be desirable to provide a way to improve the uniformity of the dye image which is transferred by laser, thereby resulting in improved image uniformity, without having matte bead defects as described above in the transferred image.

These and other objects are achieved in accordance with this invention which relates to a thermal dye transfer assemblage comprising:

a) a dye-donor element comprising a support having thereon a dye layer and an infrared absorbing material associated therewith, and b) a dye-receiving element comprising a support having thereon a dye image-receiving layer having a given image area, the dye-receiving element being in a superposed relationship with the dye-donor element so that the dye layer is adjacent to the dye image-receiving layer, the improvement wherein spacer rails having a height of about 3 to about 50 μm are located between the dye-donor element and the dye-receiving element, the spacer rails being located just outside the image area of the assemblage in such a location so as to separate the dye-donor from the dye-receiver across the entire image area; and the dye-donor element support and the dye-receiving element support either being rigid and flat or being held rigid and flat in the assemblage so that there is no more than an insignificant sag at the area midway between said rails.

There are many ways to support the donor and the receiver elements. For example, a furrow and raised wave in a soft substrate created by using a sharp edge instrument or laser beam may be used. Alternatively, the rails may be coated as stripes with a polymeric material. In another embodiment, bands or tape-like material may be fastened to the edge of the receiver outside the image area. The method of forming the raised rails is not critical to the invention, but the height of the rails is. A donor/receiver separation of about 3 to about 50 μm is necessary for good results to be obtained. In a preferred embodiment, a separation of 3 to 8 μm is employed.

The thickness of the dye-donor support and dye-receiver support should be at least about 250 μm in order to be rigid and flat in an assemblage. Alternatively, the supports could be thinner but be held rigid and flat by using vacuum or electrostatic force to hold the supports against a rigid plate of glass or transparent polymeric material. In that case, the sag would be defined by the stiffness of the supporting rigid plate rather than the stiffness of the donor or receiver supports.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in U.S. Pat. No. 4,973,572, or other materials as described in the following U.S. Pat. Nos.: 4,948,777; 4,950,640; 4,950,639; 4,948,776; 4,948,778; 4,942,141; 4,952,552; 4,912,083; 4,942,141; 4,952,552; 5,036,040; and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,168,288 the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ®and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

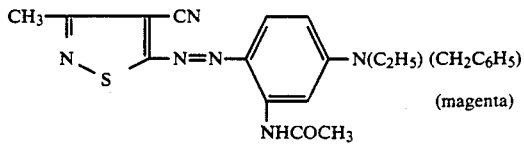

(magenta)

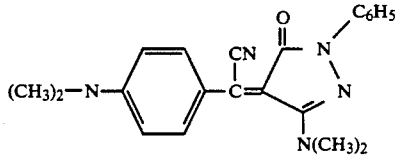

(magenta)

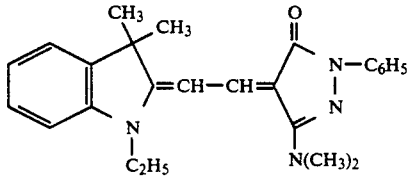

(yellow)

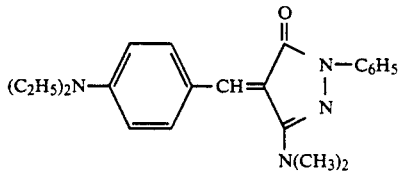

(yellow)

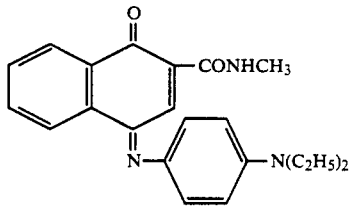

(cyan)

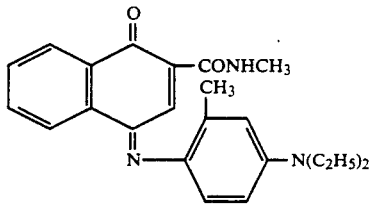

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support may also be coated with a subbing layer, if desired, such as those materials described in U.S. Pat. Nos. 4,695,288 or 4,737,486.

The dye-receiving element that is used with the dye-donor element employed in the invention generally comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, a transparent film support is employed. In another preferred embodiment, the dye-receiver support may also be dye-receptive so that a separate dye image-receiving layer is not required.

The dye image-receiving layer may comprise a polymer compatible with the dye such as, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer having an infrared-absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image, and wherein spacer rails are located between the dye-donor element and the dye-receiving element as described above.

The following examples are provided to illustrate the invention.

EXAMPLE 1

A rigid sheet of Makrolon® CD-2000 (a bisphenol-A polycarbonate) (Bayer AG) 50 mm square and 1,500 μm thick, was used as a receiver. Two cuts in the face of the receiver were made with a razor blade at a 60° angle to one another. The cuts were about 25 mm long, so that the planar distance between them varied from zero to about 25 mm. The height of the raised rails made by the razor cuts was 50 microns, as measured by a micrometer.

A neutral (black) dye-donor was prepared by coating the following layer on a 100 μm thick poly(ethylene terephthalate) support: the second yellow dye illustrated above (0.22 g/m$^2$), the first magenta dye illustrated above (0.22 g/m$^2$), the first cyan dye illustrated above (0.22 g/m$^2$), and the infrared-absorbing dye illustrated below (0.054 g/m$^2$), in a cellulose acetate propionate binder (2.5% acetyl, 45% propionyl)(0.61 g/m$^2$) coated from a 4-methyl-2-hexanone and ethanol solvent mixture.

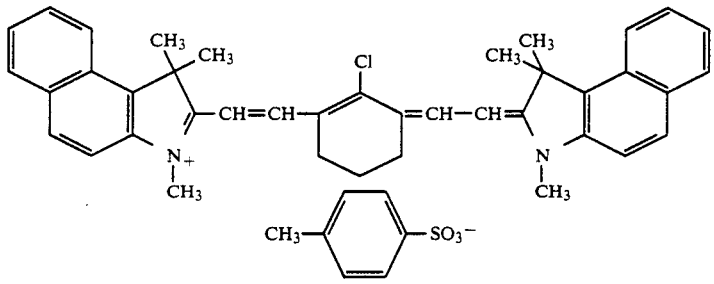

Cyanine Infrared Absorbing Dye

Single color black images were printed as described below from the dye donor sheet onto the receiver containing the raised rails using a laser imaging device similar to the one described in U.S. Pat. No. 5,105,206. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum groves. The platen was attached to a moveable stage whose position was controlled by a lead screw which determined the y axis position of the image.

The receiver was held tightly to the platen and the dye-donor element was held tightly to the receiver by means of an applied vacuum.

Because of the flexibility of the donor support, the donor and receiver were in intimate contact everywhere except within 2 mm of the rail. This intimately contacted area constituted the control area of the image. From about 2 mm away from the edge of the raised rail to the center of the raised rail was an area of gradually increasing separation between the donor and receiver, from 0 to 50 microns. By measuring the distance from the center of the rail as a fraction of the total separated distance, the donor/receiver separation was calculated by triangulation. The area between the two intersecting raised rails where the rails were less than 4 mm apart constituted the image area of this example. In that area the donor and receiver were fully separated to the rail height.

The assembly of donor and receiver was exposed to a swept laser beam as described in the above U.S. Pat. No. 5,105,206.

The laser beam had a wavelength of 830 nm and a power output of 37 mWatts at the platen. The measured spot size of the laser beam was an oval 7 by 9 microns (with the long dimension in the direction of the laser beam sweep). The center-to center line distance was 12 microns (2120 lines per inch) with a laser scanning speed of 825 mm/sec. Imaging was done at full laser power.

After the entire area of the donor/receiver had been printed by the laser, the donor was separated from the receiver and the image was evaluated by microscopy and by microdensitometry. The following results were obtained:

| Rail Height (μm) | Density |
|---|---|
| 44 | .20 |
| 37 | .27 |
| 31 | .27 |
| 25 | .32 |
| 19 | .45 |
| 12 | .50 |
| 6 | .62 |
| 0 | .01 |

The above results indicate that in the control where there was intimate contact of donor and receiver, the density printed was practically zero, with a few small spots (about 0.25 mm square) of high density where the donor dye layer had been ripped off the support. When the height of the rails was from about 3 to about 50 μm, an increase in density was This data of this example show that the thickness of the rail is important, and that both the donor and receiver must be held rigid and flat if a uniform separation between the donor and receiver is to be maintained over the distance between the rails. In this case, the 100 μm thick poly(ethylene terephthalate) support used for the dye donor was only rigid enough to hold the separation between the donor and receiver for a distance of about 3 mm, with a differential vacuum level of about 28 mm of mercury.

EXAMPLE 2

This example was similar to example 1, except the raised rails consisted of strips of Scotch Brand® 810 Mending Tape (3M Co.) on the polycarbonate sheet. The thickness of the rails was about 30 microns as measured by a micrometer. The image area was about 3 mm wide between the raised rails, and produced a printed density of 1.0 when laser printed as described in Example 1. The control area was the same as Example 1 and gave essentially no density.

EXAMPLE 3

This example was similar to Example 1, except the raised rails consisted of two strips of 6 micron thick poly(ethylene terephthalate), which remained attached to the polycarbonate sheet by static electricity. The image area was about 1 mm wide between the rails, and produced a printed density of 1.5. The control area was the same as Example 1 and gave essentially no density.

EXAMPLE 4

This example was similar to Example 1, except the raised rails consisted of a layer of gelatin which was applied to the surface of the receiver by means of a small paint brush with a 12.5% solution of gelatin in warm water. After the gelatin band was applied to the polycarbonate sheet, it was allowed to dry. The image area was about 0.5 mm wide between the raised rails, and produced a printed density of 1.8. The control area was the same as Example 1 and gave essentially no density.

EXAMPLE 5

This example was similar to example 4, except the rails consisted of a layer of gelatin mixed with 8 micron diameter crosslinked polystyrene beads. The amount of the beads was about equal to the amount of dry gelatin (approximately 12.5%). The beads consisted of 95% poly-styrene crosslinked with 5% divinylbenzene. The mixture of beads and gelatin was applied to the surface of the receiver by means of a small paint brush from a 12.5% solution of gelatin in warm water. The image area was about 1 mm wide between the raised rails, and produced a printed density of 1.5. The control area was the same as Example 1 and gave essentially no density.

EXAMPLE 6

Rigid donors were made by spin coating each of the following solutions of dyes onto 6.4 cm square glass plates which were 0.08 cm thick. The spin rate was 1120 rpm.

Cyan Dye Donor Mixture 1 part of the first cyan dye illustrated above,
1 part of the second cyan dye illustrated above,
2 parts of the infrared dye of Example 1,
100 parts 4-methyl-2-pentanone, and
25 parts of n-propanol.

Black Dye Donor Mixture 145 parts of the first cyan dye illustrated above,
175 parts of the second cyan dye illustrated above,
225 parts of the first magenta dye illustrated above,
155 parts of the first yellow dye illustrated above,
175 parts of the infrared dye of Example 1,
350 parts Nitrocellulose, 1139 seconds viscosity (Aqualon Corp.), and
12320 parts of 4-methyl-2-pentanone.

Flexible donors were made by spin coating each of the solutions of dyes onto 6.4 cm×6.4 cm×0.01 cm sheets of poly(ethylene terephthalate).

Rigid receivers were made by spin coating a 5% solution of Butvar® B76 (Monsanto Corp.) onto 6.4 cm square glass plates which were 0.08 cm thick. The spin rate was 520 rpm.

Flexible receivers were made by spin coating a 5% solution of Butvar® B76 (Monsanto Corp.) onto 6.4 cm×6.4 cm×0.01 cm sheets of poly(ethylene terephthalate).

A second flexible receiver was made by coating 0.02 cm thick poly(ethylene terephthalate) with 2.15 g/m$^2$ of Butvar® B76 (Monsanto), on an x-hopper coating machine at 33.5 g/m$^2$ wet lay down at 13.7 meters per minute from butanone solvent, and drying at 71° C.

Control Dye-Donor Element with Beads

Preparation of Dye Coating

To a container was added:

62 g of the first cyan dye illustrated above,
62 g of the second cyan dye illustrated above,
30 g Cellulose Acetate Propionate,
4 g the infrared dye of Example 1, and
150 g isobutanol.

The container was filled to 1000 cc with methyl hexanone, 150 cc of dimethylformamide was added and the mixture was stirred until dissolved.

The coating solution was coated on an unsubbed 0.01 cm sheet of poly(ethylene terephthalate) support at 10.5 g/m$^2$ wet lay down and dried at 82° C.

Overcoat 7 g polystyrene beads, 8.3 μm average size,
7 g polyvinylacetate emulsion, 50% solids,
4 g Surfactant 10-G (Olin Corp.), and 3200 g water.

The above coating was coated over the dye layer at 19 g/m$^2$ wet laydown and dried at 115° C.

The diode laser apparatus used to expose the donor-receiver combinations is described in U.S. Pat. No. 5,053,791, and consists of metal platen with a vacuum groove used to hold a flexible film flat in the plane of a focused diode laser beam which is modulated and swept across the platen to write lines of the image. After each line is written, the platen is incrementally moved in the direction orthogonal to the line by a stepping motor. In this way the entire image is addressed, line by line.

Rigid Donor and Flexible Receiver

In the case of a rigid donor and a flexible receiver, the receiver was held flat by the vacuum groove in the metal platen. The rigid cyan donor was held against the receiver with two strips of plastic film 0.6 cm by 2.5 cm. by 0.001 cm thick which served as the rails to separate the donor and receiver. The donor was held in place by light finger pressure while the image was written. After writing, the image was fused by placing the receiver in an acetone vapor chamber at room temperature for 5 minutes. The result was a uniform, high contrast image with no sticking or bead shadows.

Rigid Donor and Rigid Receiver

In the case of the rigid donor and rigid receiver, the donor and receiver were again separated by the 0.001 cm thick rails, and the assembly of donor and receiver with the rails was held against the platen by light finger pressure while the image was written. Both the black and the cyan rigid donors were tested. After writing, the image was fused by placing the receiver in an acetone vapor chamber at room temperature for 5 minutes. The result was a uniform, high contrast image with no sticking or bead shadows.

Flexible Donor and Rigid Receiver

In the case of the flexible donor, an additional part was required which was a clear plastic holder with a vacuum groove used to hold the flexible donor flat during printing.

This vacuum holder was constructed from clear polycarbonate plastic, so the diode laser beam could be focused through the plastic. The assembly consisting of the black flexible donor held against the plastic holder by vacuum, the rails, and the rigid receiver was held by light finger pressure against the platen during printing. The result was a uniform, high contrast image with no sticking or bead shadows.

Flexible Donor and Flexible Receiver

In this case the 0.02 cm thick flexible receiver was held by vacuum against the metal platen and the black flexible donor was held by vacuum against the clear plastic holder. The assembly including the rails was held against the platen by light finger pressure during printing. After writing, the image was fused by placing the receiver in an acetone vapor chamber at room temperature for 5 minutes. The result was a uniform, high contrast image with no sticking or bead shadows.

Control #1 —Flexible Donor and Flexible Receiver with No Rails

The cyan spin coating described above was held in close contact by vacuum with the 0.01 cm flexible receiver. After writing the image, the donor and receiver ere stuck together so tightly that most of the receiver coating peeled off the support when the donor and the receiver were separated, resulting in a totally unacceptable image.

Control #2 —Flexible Donor with Beads and Flexible Receiver with No Rails

The cyan control coating described above was held in close contact by vacuum with the 0.01 cm flexible receiver. After writing the image and fusing the receiver in acetone vapor for 5 minutes, microscopic inspection at 35×revealed many white bead shadows in the image.

Summary Table of Experimental Results

| Color | Donor | Receiver | Spacer | Sticking | Micromottle (Bead Shadows) |
|---|---|---|---|---|---|
| Cyan | Rigid | Rigid | Rails | No | No |
| Black | Rigid | Rigid | Rails | No | No |
| Cyan | Rigid | Flexible | Rails | No | No |
| Black | Flexible | Rigid | Rails | No | No |
| Black | Flexible | Flexible | Rails | No | No |
| Controls | | | | | |
| Cyan | Flexible | Flexible | None | Yes | No |
| Cyan | Flexible | Flexible | Beads | No | Yes |

The above results show that no sticking or bead shadows were obtained using the spacer rails of the invention with either rigid supports or flexible supports held rigid. The control elements with flexible supports or beads had sticking or bead shadows.

The invention has been described in detail with particular reference to preferred embodiments thereof, but it will be understood that variations and modifications can be effected within the spirit and scope of the invention.

What is claimed is:

1. In a thermal dye transfer assemblage comprising:

a) a dye-donor element comprising a support having thereon a dye layer and an infrared absorbing material associated therewith, b) a dye-receiving element comprising a support having thereon a dye image-receiving layer having a given image area, said dye-receiving element being in a superposed relationship with said dye-donor element so that said dye layer is adjacent to said dye image-receiving layer, the improvement wherein spacer rails having a height of about 3 to about 50 μm are located between said dye-donor element and said dye-receiving element, said spacer rails being located just outside said given image area of said dye image-receiving layer in such a location so as to separate said dye-donor element from said dye-receiving element; and c) said dye-donor element support and/or said dye-receiving element support being rigid and flat in said assemblage so that there is no more than an insignificant sag at an area midway between said rails.

2. The assemblage of claim 1 wherein said spacer rails have a height of from about 3 to about 8 μm.

3. The assemblage of claim 1 wherein said infrared-absorbing material is an infrared-absorbing dye.

4. The assemblage of claim 1 wherein said support for said dye-receiving element is a transparent film.

5. In a process of forming a laser-induced thermal dye transfer image comprising the steps of:

a) contacting at least one dye-donor element comprising a support having thereon a dye layer having an infrared-absorbing material associated therewith, with a dye-receiving element comprising a support having thereon a dye image-receiving layer having a given image area to form an assemblage;

b) imagewise heating said dye-donor element by means of a laser; and c) transferring a dye image to said dye-receiving element to form said laser-induced thermal dye transfer image, wherein the improvement includes providing spacer rails having a height of about 3 to about 50 μm between said dye-donor element and said dye-receiving element, locating said spacer rails just outside said given image area of said dye image-receiving layer in such a manner so as to separate said dye-donor element from said dye-receiving element; and said dye-donor element support and/or said dye-receiving element support being rigid and flat in said assemblage so that there is no more than an insignificant sag at an area midway between said rails.

6. The process of claim 5 wherein said spacer rails have a height of from about 3 to about 8 μm.

7. The process of claim 5 wherein infrared-absorbing material is an infrared-absorbing dye.

8. The process of claim 5 wherein said support for said dye-receiving element is a transparent film.

9. In a thermal dye transfer assemblage comprising:

a) a dye-donor element comprising a support having thereon a dye layer and an infrared absorbing material associated therewith, b) a dye-receiving element comprising a support having thereon a dye image-receiving layer having a given image area, said dye-receiving element being in a superposed relationship with said dye-donor element so that said dye layer is adjacent to said dye image-receiving layer, the improvement wherein spacer rails having a height of about 3 to about 50 μm are located between said dye-donor element and said dye-receiving element, said spacer rails being located just outside said given image area of said dye image-receiving layer in such a location so as to separate said dye-donor element from said dye-receiving element; and c) means for holding said dye-donor element support and/or said dye-receiving element support rigid and flat in said assemblage so that there is no more than an insignificant sag at an area midway between said rails.

10. The assemblage of claim 9 wherein said spacer rails have a height of from about 3 to about 8 μm.

11. The assemblage of claim 9 wherein said infrared-absorbing material is an infrared-absorbing dye.

12. The assemblage of claim 9 wherein said support for said dye-receiving element is a transparent film.

13. In a process of forming a laser-induced thermal dye transfer image comprising the steps of:

a) contacting at least one dye-donor element comprising a support having thereon a dye layer having an infrared-absorbing material associated therewith, with a dye-receiving element comprising a support having thereon a dye image-receiving layer having a given image area to form an assemblage;

b) imagewise-heating said dye-donor element by means of a laser;

c) transferring a dye image to said dye-receiving element to form said laser-induced thermal dye transfer image, the improvement wherein spacer rails having a height of about 3 to about 50 μm are located between said dye-donor element and said dye-receiving element, said spacer rails being located just outside said given image area of said dye image-receiving layer in such a location so as to separate said dye-donor element from said dye-receiving element; and d) holding said dye-donor element support and/or said dye-receiving element support rigid and flat in said assemblage so that there is no more than an insignificant sag at an area midway between said rails.

14. The process of claim 13 wherein said spacer rails have a height of from about 3 to about 8 μm.

15. The process of claim 13 wherein infrared-absorbing material is an infrared-absorbing dye.

16. The process of claim 13 wherein said support for said dye-receiving element is a transparent film.

* * * * *